US005590876A

United States Patent [19]

Sejnowski

[11] Patent Number: 5,590,876

[45] Date of Patent: Jan. 7, 1997

[54] BALL TOSSING DEVICE

[75] Inventor: Joseph P. Sejnowski, Cumberland, R.I.

[73] Assignee: Hasbro, Inc., Pawtucket, R.I.

[21] Appl. No.: 415,866

[22] Filed: Apr. 3, 1995

[51] Int. Cl.[6] ..... A63B 69/40

[52] U.S. Cl. ..... 473/417; 473/451

[58] Field of Search ..... 273/26 R, 26 D, 273/29 A

[56] References Cited

U.S. PATENT DOCUMENTS

| | | | |
|---|---|---|---|
| 2,705,003 | 3/1955 | Schensted | 273/26 R |
| 3,080,859 | 3/1963 | Benkoe . | |
| 3,139,700 | 7/1964 | Wyrick | 273/26 R X |
| 3,394,691 | 7/1968 | Brink . | |
| 3,446,199 | 5/1969 | Saveca . | |
| 3,545,752 | 12/1970 | Hill | 273/26 R |
| 3,612,027 | 10/1971 | Makino | 273/26 R |
| 3,627,319 | 4/1971 | Skyhawk | 273/26 R |
| 3,841,294 | 10/1974 | McGill . | |
| 3,856,300 | 12/1974 | Payne | 273/26 R |
| 3,883,138 | 5/1975 | Chorey . | |
| 4,402,507 | 9/1983 | Hudson . | |
| 4,709,924 | 12/1987 | Wilson et al. . | |
| 4,778,177 | 10/1988 | Taksony . | |
| 4,865,318 | 9/1989 | Lehmann et al. . | |
| 4,907,802 | 3/1990 | Gatin | 273/26 D |

*Primary Examiner*—Theatrice Brown
*Attorney, Agent, or Firm*—Kurt R. Benson

[57] ABSTRACT

A ball tossing device includes a ball tossing mechanism for mechanically tossing a ball into the air, a timer assembly, and a remote manual actuating mechanism for remotely actuating the timer assembly for releasing the ball tossing mechanism to toss the ball into the air upon the expiration of a predetermined time interval. The device further includes a launching tube which is alternatively positionable in a first position for launching the ball in a vertical direction or a second position for launching the ball in an upward and outward direction.

7 Claims, 9 Drawing Sheets

BALL TOSSING DEVICE

BACKGROUND AND SUMMARY OF THE INVENTION

The instant invention relates to the sport of baseball and more particularly to a ball tossing device for aiding young children in the development of batting skills.

A variety of different types of devices have been heretofore available for aiding persons of various ages in the development of baseball batting skills. For example, a variety of different types of batting tees have been heretofore available for positioning balls in upwardly spaced relation to supporting surfaces during batting exercises. Devices of this type have generally been found to be effective for assisting young children in the development of the earliest stages of batting skills, and they have also been found to be effective for use in a baseball-related game called "Tee-Ball". Ball tossing devices which toss balls upwardly into the air have generally been found to be effective for aiding children in the development of slightly more advanced batting skills, and various types of apparatus which are capable of tossing or pitching balls have been found to be effective for aiding both children and adults in the development of advanced batting skills. However, the heretofore available devices of these types have generally not been adapted for use by children having different levels of skill, and hence they have not been effectively adapted for use by children of different ages.

Ball tossing devices which are exemplary of some of the abovereferenced prior art devices are disclosed in the Benkoe U.S. Pat. No. 3,080,859; Brink U.S. Pat. No. 3,394,691; Saveca U.S. Pat. No. 3,446,199; Hill U.S. Pat. No. 3,545,752; Makino U.S. Pat. No. 3,612,027; McGill U.S. Pat. No. 3,841,294; Chorey U.S. Pat. No. 3,883,138; Hudson U.S. Pat. No. 4,402,507; Wilson et al. U.S. Pat. No. 4,709,924; Taksony U.S. Pat. No. 4,778,177; Lehmann et al., U.S. Pat. No. 4,865,318; and Gatin U.S. Pat. No. 4,907,802. However, these devices have generally not been adapted to accommodate users having various different levels of skill, and, hence, they are believed to be of only general interest with respect to the ball tossing device of the subject invention.

The instant invention provides a ball tossing device which is adaptable for various different modes of operation and which therefore represents a significant improvement over the heretofore available ball tossing devices. Specifically, the instant invention provides a ball tossing device which is alternatively operative in a first mode of operation in which a ball is held in a substantially stationary disposition in upwardly spaced relation to a supporting surface, in a second mode of operation in which a ball is tossed substantially vertically upwardly from the device, or a third mode of operation in which a ball is tossed upwardly and outwardly from the device. Accordingly, the device of the instant invention can be utilized for positioning a ball in a stationary position for aiding a young child in the development of the initial stages of his or her ball hitting skills. The device is alternatively operative for tossing a ball substantially vertically upwardly for aiding a child in the development of a slightly more advanced level of batting skills, and the device is operative in a third mode of operation for tossing a ball to a child for aiding in the development of a still more advanced level of batting skills.

Still more specifically, the ball tossing device of the instant invention comprises a base which is receivable on a supporting surface and a ball tossing mechanism which is remotely actuatable for tossing a ball into the air. The tossing mechanism is adapted so that it is alternatively operative for tossing a ball into the air in a first direction which extends substantially vertically upwardly from the base, or a different second direction which extends upwardly and outwardly therefrom. The ball tossing mechanism preferably includes a foot pedal which is manually operative for moving the tossing mechanism to a cocked position and a remote release pedal which is operative for remotely actuating the tossing mechanism to toss a ball. The tossing mechanism preferably includes a launching tube which is operative for controlling the direction in which the ball is tossed, and the launching tube is preferably alternatively positionable in a first substantially vertical position for launching a ball in the first or vertical direction or a second non-vertical position for launching the ball in the second or upwardly and outwardly extending direction. The release pedal is preferably pneumatically operative for remotely actuating the tossing mechanism, and the tossing mechanism preferably includes a mechanical timer for providing a predetermined delay interval between the time when the release pedal is operated and the time when a ball is tossed into the air by the tossing mechanism. The ball tossing device preferably further includes a batting tee element which is receivable in the launching tube when the launching tube is in the first substantially vertical position thereof for supporting a ball in upwardly spaced relation to the base.

Accordingly, the ball tossing device of the instant invention provides a significant advancement over the heretofore available ball tossing devices. In this regard, the ball tossing device of the instant invention is adapted so that it is adjustable for use by children having different levels of skill to substantially increase the versatility of the device, and it is remotely actuatable for enabling a batter to more effectively assume a batting position before a ball is tossed into the air.

Accordingly, it is a primary object of the instant invention to provide a ball tossing device which is adjustable to compensate for different levels of skill of various users.

Another object of the instant invention is to provide a ball tossing device which is alternatively operative for tossing a ball in a first vertically upwardly extending direction or a second upwardly and outwardly extending direction.

Another object of the instant invention is to provide a ball tossing device which is alternatively operative for tossing a ball to a user or for receiving a batting tee for supporting the ball in a stationary position.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
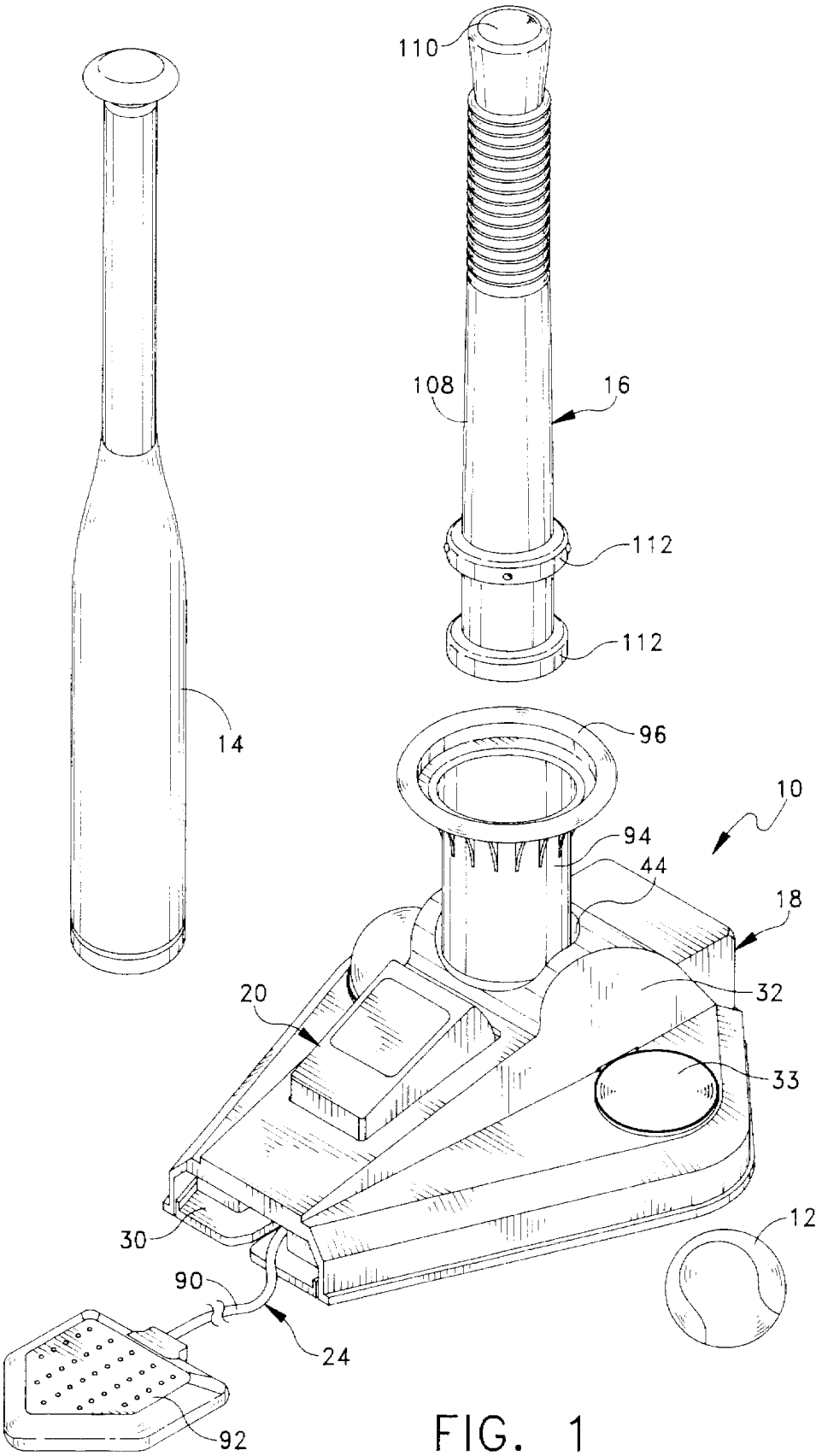
FIG. 1 is a perspective view of the ball tossing device of the instant invention with a ball and bat and with the batting tee removed.
Figure 2:
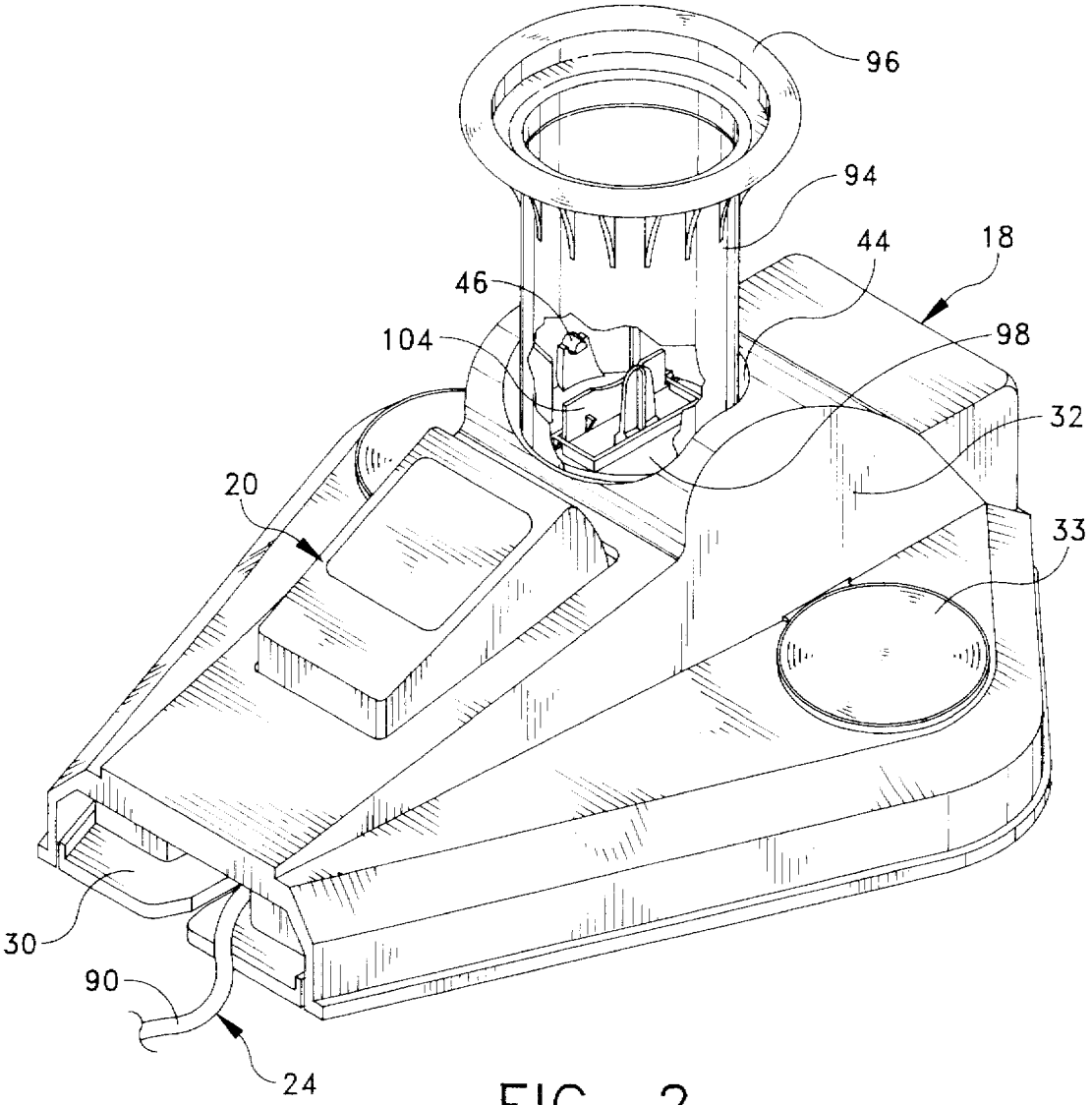
FIG. 2 is a perspective view of the main portion of the ball tossing device with portions of the launching tube broken away.
Figure 3:
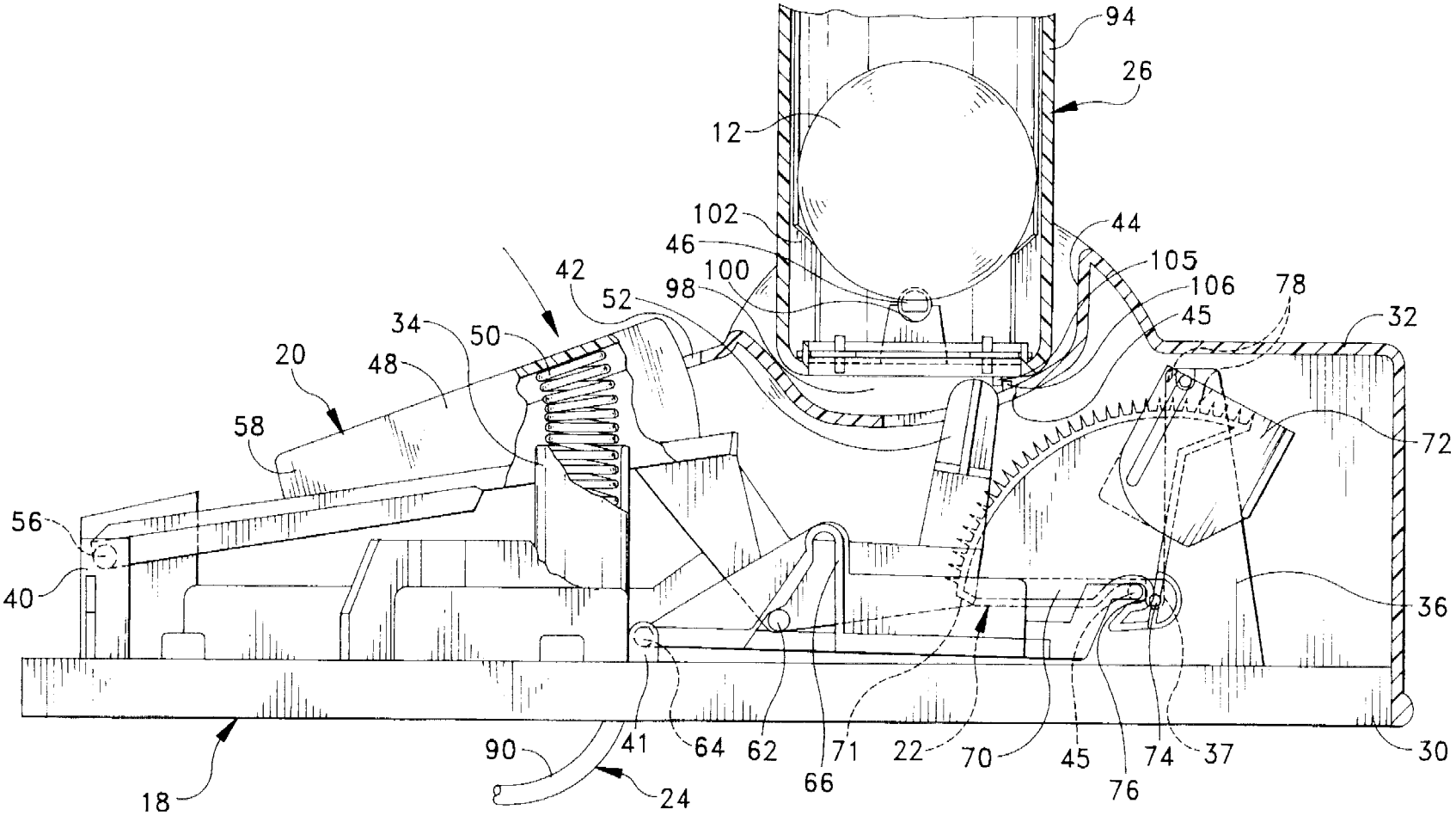
FIG. 3 is a right side elevational view thereof shown in partial section in a cocked position.
Figure 6:
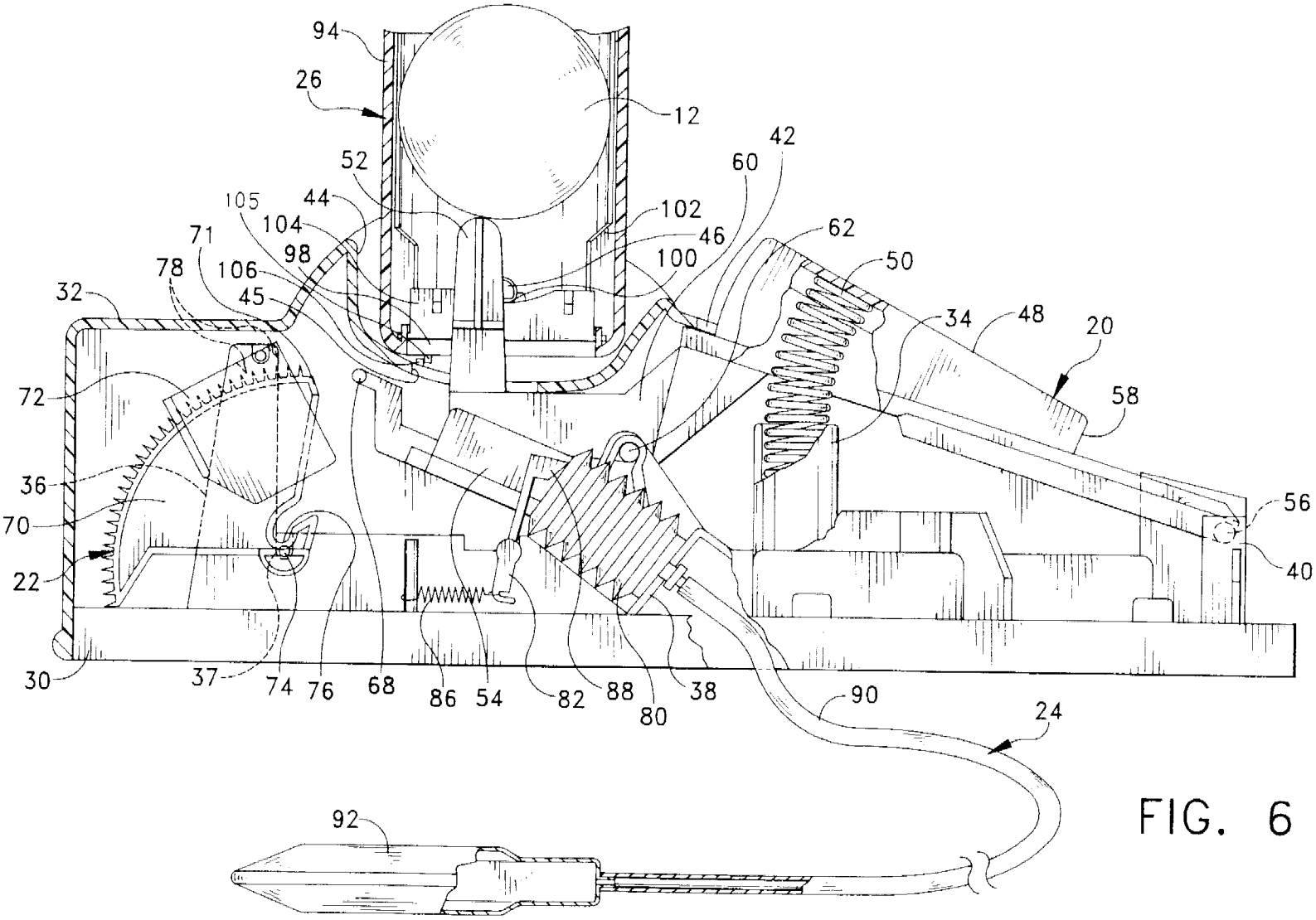
FIG. 6 is a similar view thereof in a released position.
Figure 7:
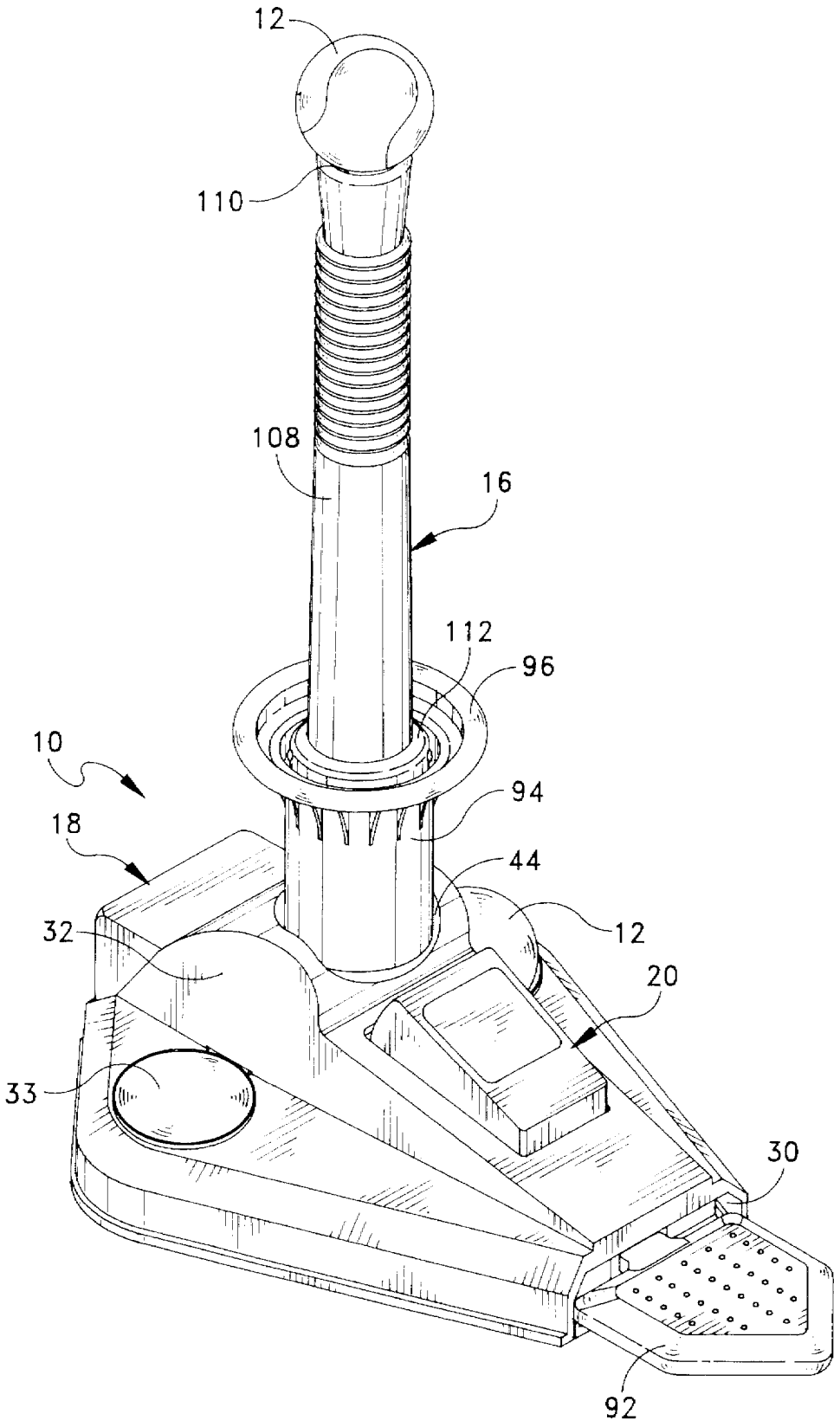
FIG. 7 is a perspective view of the ball tossing device as used with the batting tee thereof.
Figure 8:
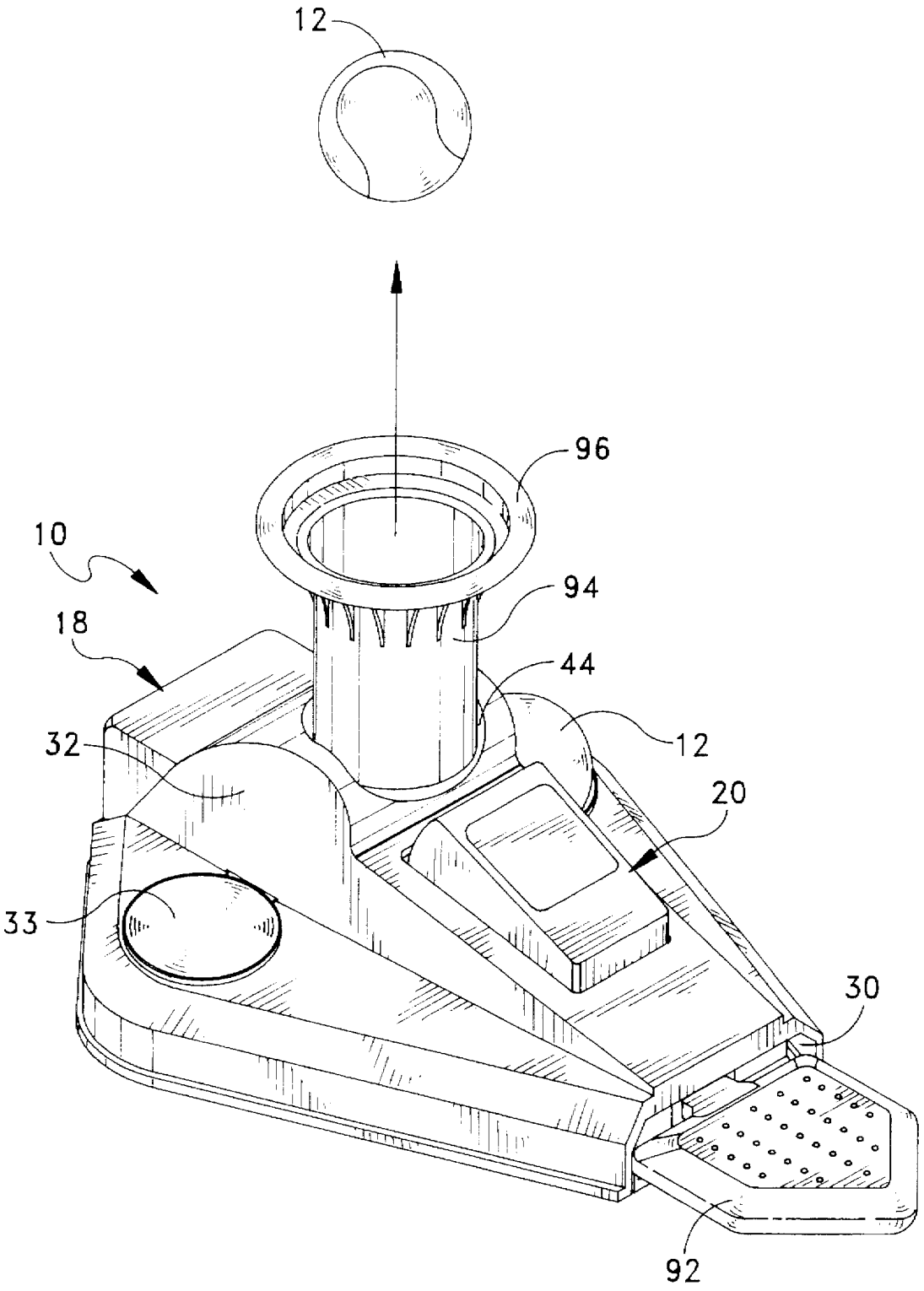
FIG. 8 is a perspective view of the ball tossing device as used for tossing a ball in a vertical direction.
Figure 9:
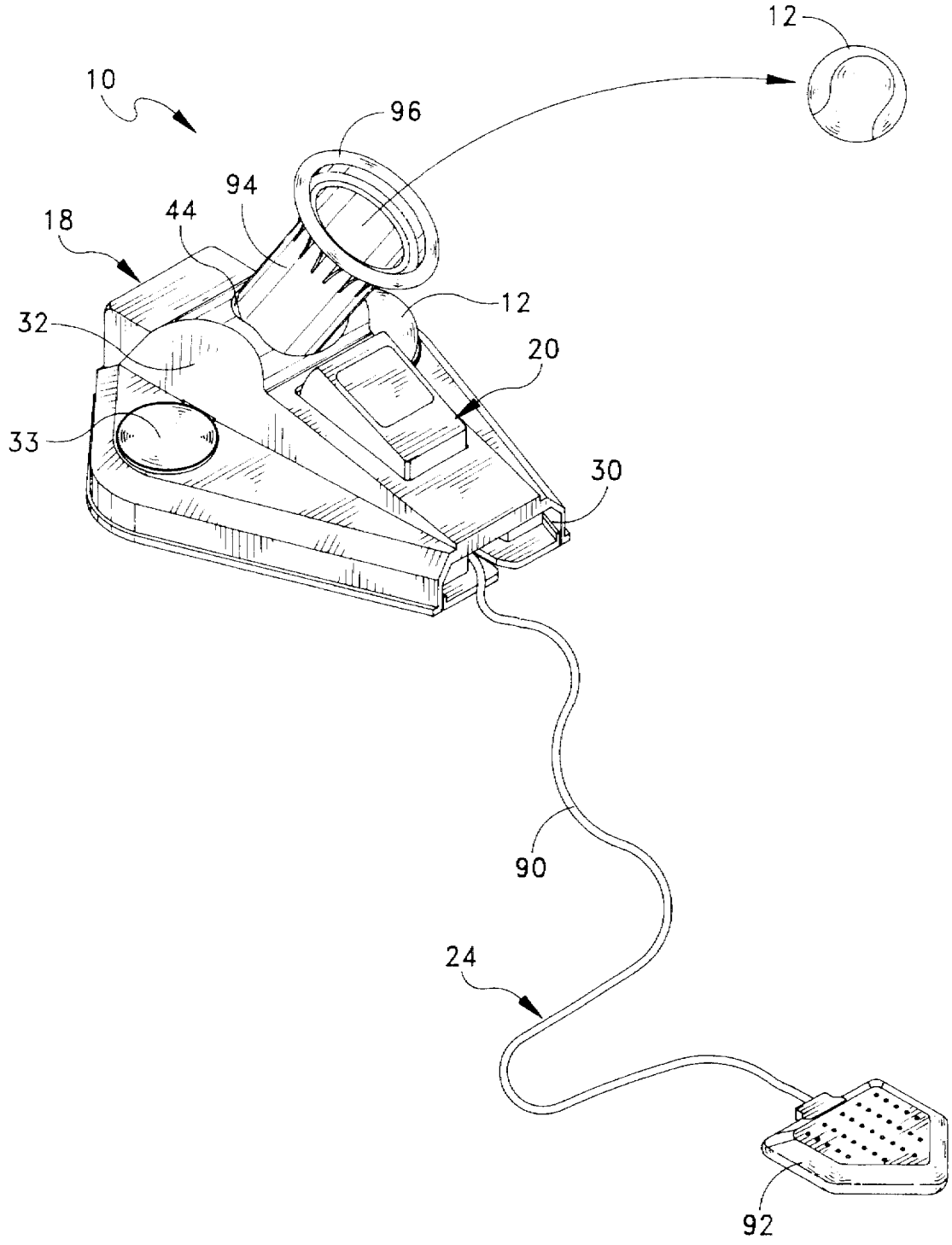
FIG. 9 is a perspective view thereof as used for tossing a ball in an upward and outward direction.

Referring now to the drawings, the ball tossing device of the instant invention is illustrated and generally indicated at 10 in FIGS. 1–9. The ball tossing device 10 is operative in combination with a ball 12 and a bat 14, and as illustrated in FIGS. 3, 5, 8, and 9, the device 10 is operative for tossing the ball 12 into the air so that a user of the device 10 can strike the ball 12 with the bat 14. Further, as illustrated in FIGS. 8 and 9, the device 10 is adapted so that it is alternatively operative for tossing the ball 12 substantially vertically upwardly in the manner illustrated in FIG. 8 or upwardly and outwardly in the manner illustrated in FIG. 9. Still further, as illustrated in FIGS. 1 and 7, the ball tossing device 10 is adapted for use in combination with a batting tee member 16 for positioning the ball 12 in upwardly spaced relation to a supporting surface so that a user of the device 10 can strike the ball 12 with the bat 14 while the ball 12 is held in a stationary position.

The ball tossing device 10, as illustrated in FIGS. 1–9, comprises a base assembly generally indicated at 18, a foot pedal assembly generally indicated at 20, a timer assembly generally indicated at 22, an actuating assembly generally indicated at 24, and a launching tube generally indicated at 26. During operation of the device 10, the foot pedal assembly 20 is operative for moving the device 10 to a cocked or loaded position and for tossing the ball 12 into the air as it is released to an uncocked or unloaded position. The timer assembly 22 is operative for retaining the foot pedal assembly 20 in the cocked position, and the actuator assembly 24 is operative for actuating or releasing the timer assembly so as to cause the timer assembly to release the foot pedal assembly 20 for tossing the ball 12 into the air upon the expiration of the predetermined time interval. The launching tube 26 is received and mounted on the base assembly 18 so that the launching tube 26 is alternatively positionable in the first position illustrated in FIGS. 1–8 or the second position illustrated in FIG. 9. Further, the launching tube 28 is received on the base 18 so that the foot pedal assembly 20 can communicate with the interior of the launching tube 28 for launching the ball 12 into the air as the foot pedal assembly 20 is released.

The base assembly 18 comprises a base member 30 which is adapted to be received on a supporting surface and an upper housing member 32 which is received and secured on the base member 30 to provide a substantially enclosed housing for containing the timer assembly 22, portions of both the foot pedal assembly 20, and the actuator assembly 24. The base member 30 has a pair of ball receiving recesses therein, and it includes various mounting structures for mounting components of the foot pedal assembly 20, the timer assembly 22 and the actuator assembly 24 thereon, including a tubular spring retainer 34, a pair of timer mounting posts 36, a pair of mounting notches 37 adjacent the lower end of the mounting posts 36, a bellows mounting wall 38, a pair of foot pedal pivot mounts 40, and a pair of connector plate mounts 41. The upper housing section 32 includes a foot pedal opening 42 and an upwardly facing launching tube recess 44 having an opening 45 in the bottom end thereof and having a pair of opposed inwardly extending launching tube mounting pins 46 therein. The upper housing section 32 is secured to the base member 30 in a conventional manner with screws (not shown).

The foot pedal assembly includes a pivotally mounted foot pedal element 48, a spring 50, a launching member 52, and a connector plate 54. The foot pedal element 48 is pivotally received in the opening 42, and it is mounted in the mounts 40 with a pair of integrally formed pins 56. The foot pedal element 48 includes a pedal portion 58 and an extension arm 60 extends integrally from the pedal portion 58 to a point below the recess 44. The launching member 52 extends integrally upwardly from the extension arm 60 so that it is receivable through the opening 45 in the recess 44 for contacting the ball 12. The extension arm 60 includes a pair of pins 62 which extend outwardly from opposite sides thereof. The connector plate 54 includes a pair of pivot pins 64 which are pivotally received in the connector plate mounts 41. The connector plate 54 also includes a pair of spaced yoke sections 66 in which the pins 62 are received and a retaining pin 68 which is receivable in engagement with the timer assembly 22 in order to retain the connector plate 54 in a downward position. Accordingly, when the retaining pin 68 is received in engagement with the timer assembly 22, the connector plate 54 is operative for retaining the foot pedal element 48 in a downward position against the bias of the spring 50, and when the foot pedal element 48 is held in the downward position, the launching member 52 is retracted downwardly through the opening 45. However, when the retaining pin 68 is released by the timer assembly 22, the connector plate 54 is rapidly pivoted upwardly allowing the foot pedal element 48 to also be rapidly pivoted upwardly by the spring 50 causing the launching member 52 to be rapidly advanced upwardly through the opening 45 for engaging the ball 12.

Figure 4:
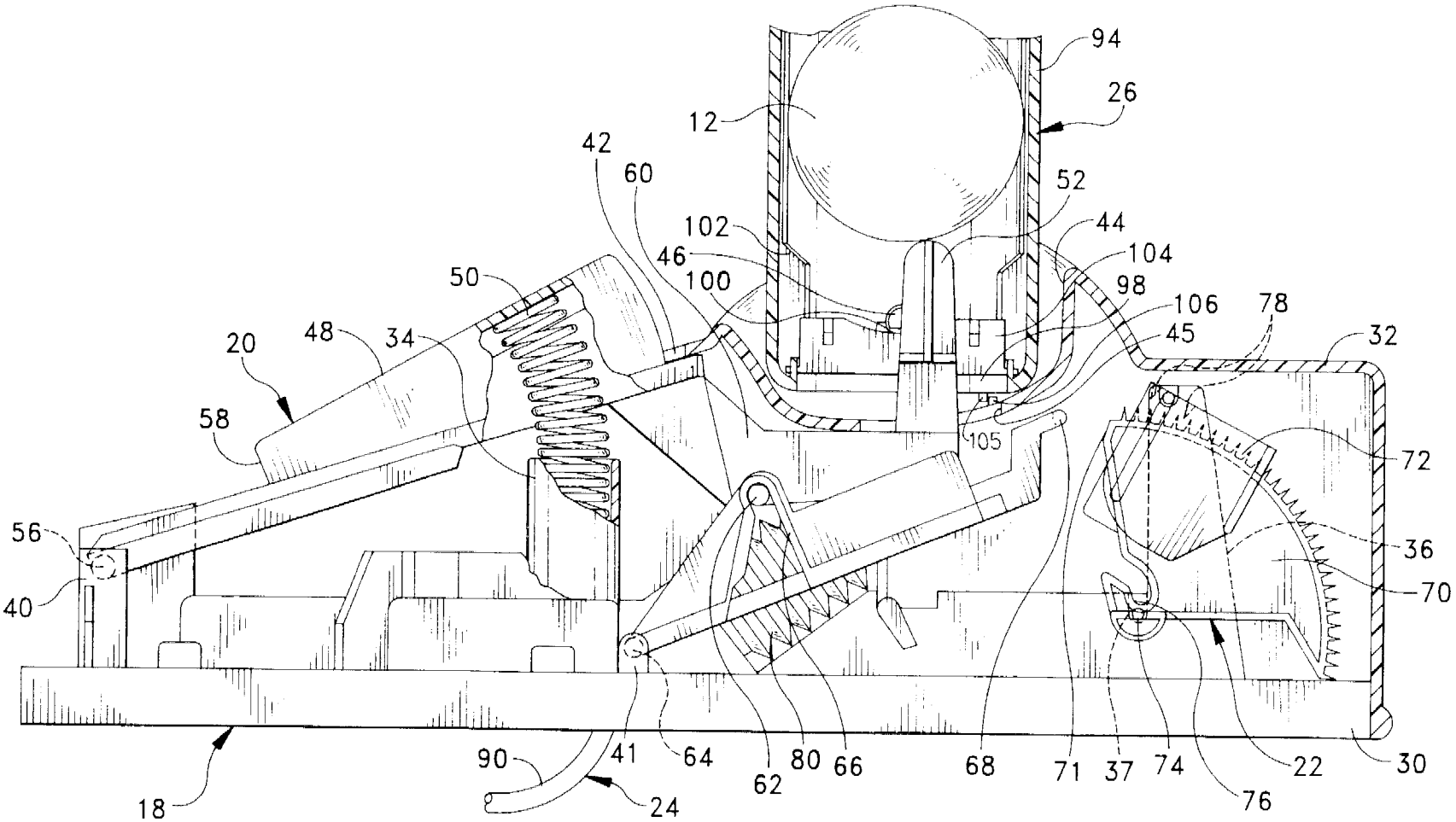
FIG. 4 is a similar sectional view thereof in a released position.
Figure 5:
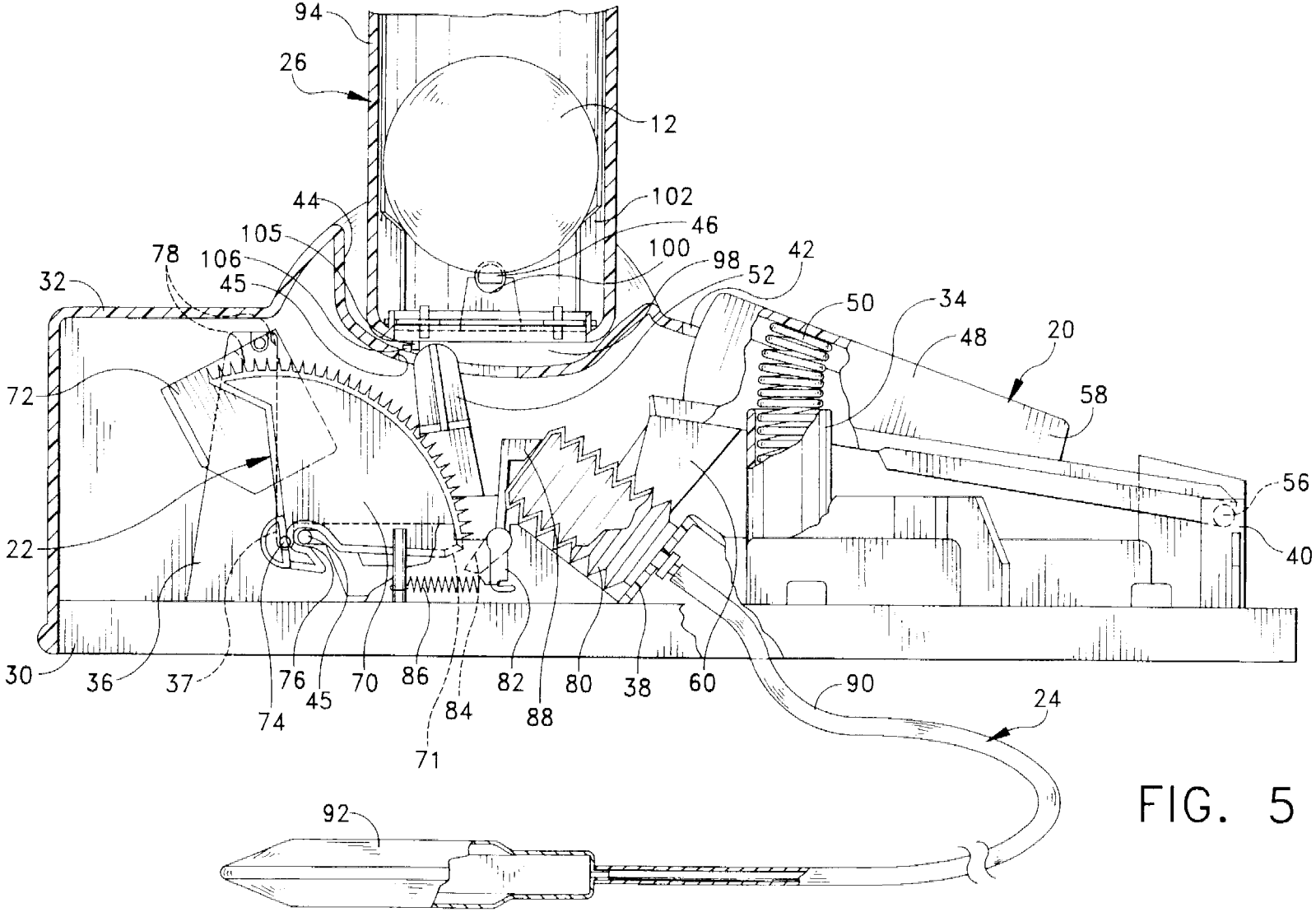
FIG. 5 is a left side elevational view thereof shown in partial section in a cocked position.

The timer assembly 22 includes a timer gear 70 having a retaining tab 71 thereon and a ratchet member 72 which is pivotally mounted on the mounting posts 36. The timer gear 70 includes a pair of pivot pins 74 which are rotatably received in the notches 37 for pivotally mounting the timer gear 70 so that it is movable between the first or cocked position thereof illustrated in FIGS. 3 and 5, and the released or second position thereof illustrated in FIGS. 4 and 6. The timer gear 70 extends over an arc of slightly greater than 90 degrees, and it includes an open slot 76 which extends inwardly to a point which is closely spaced outwardly from the axis of the pins 74. The notch 76 is adapted for receiving the retaining pin 68 therein for retaining the connector plate 54 and the foot pedal element 48 in the downward or cocked positions thereof when the timer gear 70 is in the cocked position illustrated in FIGS. 3 and 5. Further, when the foot pedal element 48 and the connector plate 54 are in the upward or released positions thereof and the timer gear 70 is also in the released position thereof as illustrated in FIGS. 4 and 6, the retaining pin 68 is downwardly receivable in the slot 76 for pivoting the timer gear 70 to the cocked position thereof illustrated in FIGS. 3 and 5. Further, when the timer assembly 22 is actuated, the spring 50 operates through the foot pedal element 48, the connector plate 54, and the retaining pin 68 to bias the timer gear 70 toward the released position thereof. The ratchet member 72 is pivotally mounted on the upper ends of the mounting posts 36, and it includes a pair of inwardly directed spaced ratchet teeth 78. The ratchet member 72 is positioned so that teeth 78 are alternatively engageable with the teeth on the timer gear 70 for pivoting the ratchet member 72 back and forth in order to control the rate at which the ratchet gear 70 is pivoted from the cocked position thereof to the released position thereof. In other words, the ratchet member 72 cooperates with the timer gear 70 to define a predetermined time interval between the time when the timer gear 70 is released from the cocked position thereof to the time when the timer gear 70 reaches the released position thereof. Further, the ratchet member 72 engages the posts 36 as the ratchet member 72 is pivoted back and forth during this time interval to provide an audible ticking sound during the predetermined time interval. Once the timer gear 70 reaches the release position thereof, however, the retaining pin 68 is released from the slot 76 allowing the connector plate 54 and the foot pedal element 48 to be rapidly pivoted upwardly.

The actuator mechanism 24 comprises a bellows 80 which is mounted on the bellows mounting wall 38 and a latch member 82 which is pivotally mounted on the base member 30. The latch member 82 includes a latch portion 84 which is engageable with the retaining tab 71 on the gear 70 for retaining the gear 70 in the cocked position thereof. The actuator assembly 24 also includes a spring 86 for biasing the latch member 82 to a position in which the latch portion 84 thereof is received in engagement with the retaining tab 71. Also included in the latch member 82 is a bellows arm 88 which is positioned in engagement with the bellows element 80. The bellows element 80 comprises a pneumatically expandable bellows element which is longitudinally expandable by introducing slightly compressed air thereinto. Accordingly, the bellows element 80 is expandable to pivot the bellows arm 88 so that the latch portion 84 is disengaged from the retaining tab 71 to release the timer gear 70 so that it is advanced toward the release position thereof. The actuator assembly 24 further comprises an elongated pneumatic tube 90 and an actuator pedal 92. The actuator pedal 92 is connected to the bellows 80 through the pneumatic tube 90, and it is adapted to be compressed or deformed by stepping thereon to apply compressed air to the bellows 80. Accordingly, by stepping on the actuator pedal 92, the bellows 80 is longitudinally expanded to pivot the latch member 82 against the bias of the spring 86 to a position in which the latch portion 84 is disengaged from the retaining tab 71. This allows the upward force of the retaining pin 68 to cause the gear 70 to be rotated in the direction indicated in FIG. 5, causing the ratchet member 72 to pivot back and forth until the timer gear 70 reaches the release position illustrated in FIGS. 4 and 6. When this occurs, the connecting arm 54 and the pedal member 48 are rapidly pivoted upwardly by the spring 50, and so that the launching member 52 is rapidly advanced upwardly through the opening 45 in the recess 44 for launching the ball 12 from the launching tube 26.

The launching tube 26 comprises a tubular side wall portion 94, a flared upper end portion 96, and a bottom wall portion 98. The side wall portion 94 has a pair of openings 100 therein through which the pins 46 are rotatably received. A plurality of internal fins 102 are formed in the interior of the side wall portion 94 for positioning the ball element 12 in a predetermined launching position therein. A hingeable door 104 is provided in the bottom wall 98 for receiving the launching member 52 therethrough, and a ridge 105 is provided on the underside of the bottom wall 98. The ridge 105 cooperates with a ridge 106 formed in the recess 44 for releasably retaining the launching tube 26 in a substantially vertical position corresponding to the first position thereof. However, the launching tube 26 is nevertheless pivotable on the pins 46 for positioning it in the second position thereof illustrated in FIG. 9.

The batting tee member 16 comprises an elongated cylindrical main portion 108 having a recess 110 in the upper end thereof, and a pair of integrally formed collars 112 adjacent the lower end thereof. The batting tee member 16 is dimensioned so that the collars 112 are snugly receivable in the launching tube 26 for positioning the batting tee in a substantially vertical position when the launching tube 26 is in the first substantially vertical position thereof. As a result, the batting tee member 16 is operative for receiving the ball 12 on the upper end thereof in order to position the ball 12 in a stationary disposition in upwardly spaced relation to a supporting surface. Accordingly, the device 10 is operative with the batting tee 16 for positioning the ball 12 in a stationary batting position for young inexperienced batters.

For use and operation of the device 10, the launching tube 26 is placed in a desired position, for example a vertical position, the ball 12 is placed in the launching tube 22, and the pedal element 48 is depressed against the force of the spring 50 to retract the launching member 52 downwardly from the launching tube 26. This pivots the connecting arm 54 downwardly so that the release pin 68 is received in the slot 76 to move the timing gear 70 to the cocked or loaded position thereof illustrated in FIGS. 3 and 5. As the gear 70 approaches the cocked position thereof, the latch portion 84 is cammed out of the way of the retaining tab 71, and the latch portion 84 is then brought into engagement with the upper surface of the retaining tab 71 by the spring 86. Thereafter, the device 10 is actuatable by stepping on the actuator pedal 92 to cause the bellows element 80 to be elongated for pivoting the latch member 82 so as to disengage the latch portion 84 thereof from the retaining tab 71. This then allows the release pin 68, which is received in the slot 76, to cause the timer gear 70 to be pivoted in the direction indicated in FIG. 5 toward the release position thereof, and when the gear 70 reaches the position illustrated in FIGS. 4 and 6, the release pin 68 is released so that the connecting arm 54 and the pedal member 48 are pivoted upwardly by the spring 50. This causes the launching member 52, which is integrally formed as part of the pedal member 48, to be rapidly advanced upwardly through the opening 45 to engage the ball 12, whereby the ball 12 is launched from the launching tube 26. Alternatively, the device 10 can be operated in a similar manner with the launching tube 26 positioned in the second or angular position thereof for tossing the ball 12 in an upward and outward direction in the manner illustrated in FIG. 9, or the device 10 can be operated in combination with the batting tee element 16 in the manner illustrated in FIG. 7.

It is seen, therefore, that the instant invention provides an effective practice device for use by a young child in performing batting exercises. The device 10 can be operated in combination with the batting tee element 16 for positioning the ball 12 in a stationary position, and it can alternatively be utilized for tossing the ball 12 substantially vertically upwardly or upwardly and outwardly depending on the level of skill of the user. Accordingly, it is seen that the device of the instant invention represents a significant advancement in the toy art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A ball tossing device for tossing a ball into the air comprising:

a base receivable on a supporting surface;

tossing means on said base for tossing said ball into the air in each of a plurality of selected tossing directions, said tossing means including direction control means including a launching tube which is selectively operable for alternatively causing said ball tossing means to toss said ball into the air from said launching tube in a first tossing direction which extends substantially vertically upwardly from said base or a different second tossing direction which extends upwardly and outwardly therefrom, said tossing means further including actuating means for remotely actuating said tossing means to toss said ball into the air; and a batting tee receivable, in said launching tube when said launching tube is in a position corresponding to said first tossing direction for supporting said ball in upwardly spaced relation to said base.

2. In the ball tossing device of claim 1, said tossing means including first foot pedal means for manually moving said tossing means to a cocked position, said actuating means including remote second foot pedal means for remotely actuating said tossing means to toss said ball from a location which is spaced outwardly from said base.

3. In the ball tossing device of claim 1, said actuating means including remotely actuatable pneumatically operative foot pedal means for remotely actuating said tossing means.

4. In the ball tossing device of claim 1, said tossing means including mechanical timer means, said actuating means being remotely actuatable for tossing said ball into the air upon the expiration of a predetermined time interval as defined by said timer means.

5. A ball tossing device for tossing a ball into the air comprising:

a base receivable on a supporting surface;

tossing means on said base for tossing said ball into the air in each of a plurality of selected tossing directions said tossing means including direction control means which is, said direction control means being selectively operable for alternatively causing said ball tossing means to toss said ball into the air in a first tossing direction which extends substantially vertically upwardly from said base or a different second tossing direction which extends upwardly and outwardly therefrom, said tossing means further including means for remotely actuating said tossing means to toss said ball into the air;

batting tee means; and said tossing means being further operative for removably receiving said batting tee means in engagement therewith for supporting said ball in upwardly spaced relation thereto.

6. A ball tossing device for tossing a ball into the air comprising:

a base receivable on a supporting surface;

tossing means on said base for tossing said ball into the air in a tossing direction said tossing means including direction control means including a launching tube which is selectively operable for alternatively causing said ball tossing means to toss said ball into the air from said launching tube in a first tossing direction which extends substantially vertically upwardly from said base or a different second tossing direction which extends upwardly and outwardly therefrom, said tossing means further including means for remotely actuating said tossing means to toss said ball into the air; and batting tee means receivable in said launching tube for supporting said ball in upwardly spaced relation to said base.

7. A ball tossing device for tossing a ball into the air comprising:

a base receivable on a supporting surface;

tossing means on said base for tossing said ball into the air, said tossing means including a launching tube for launching said ball therefrom; and batting tee means removably receivable in said launching tube for supporting said ball in upwardly spaced relation thereto.

* * * * *